US007554024B2

(12) United States Patent
Miyajima

(10) Patent No.: US 7,554,024 B2
(45) Date of Patent: Jun. 30, 2009

(54) MARCHING CARRIER

(75) Inventor: Hideyuki Miyajima, Seto (JP)

(73) Assignee: Hoshino Gakki Mfg. Co., Ltd. (JP)

( * ) Notice: Subject to any disclaimer, the term of this patent is extended or adjusted under 35 U.S.C. 154(b) by 0 days.

(21) Appl. No.: 11/841,494

(22) Filed: Aug. 20, 2007

(65) Prior Publication Data

US 2008/0264236 A1 Oct. 30, 2008

(30) Foreign Application Priority Data

Apr. 27, 2007 (JP) ..... 2007-119679

(51) Int. Cl.
*G10D 13/02* (2006.01)

(52) U.S. Cl. ..... 84/421; 224/265

(58) Field of Classification Search ..... 84/421; 224/265

See application file for complete search history.

(56) References Cited

U.S. PATENT DOCUMENTS

| | | | | | |
|---|---|---|---|---|---|
| 1,191,425 | A | | 7/1916 | Huddle | |
| 3,332,593 | A | * | 7/1967 | Fauser | 224/185 |
| 4,139,132 | A | * | 2/1979 | Fairchild, Jr. | 224/265 |
| 4,236,712 | A | * | 12/1980 | Lambert, Jr. | 482/98 |
| 4,402,441 | A | * | 9/1983 | Jones et al. | 224/265 |
| 4,453,442 | A | * | 6/1984 | LaFlame | 84/421 |
| 4,799,610 | A | * | 1/1989 | Hsieh | 224/266 |
| 4,865,314 | A | * | 9/1989 | Carter, Jr. | 482/106 |
| 5,108,095 | A | * | 4/1992 | Nichols | 482/137 |
| 5,573,158 | A | * | 11/1996 | Penn | 224/265 |
| 6,323,407 | B1 | | 11/2001 | May | 84/421 |
| 6,329,583 | B1 | * | 12/2001 | May | 84/421 |
| 6,881,886 | B2 | * | 4/2005 | May | 84/421 |
| D513,289 | S | * | 12/2005 | Panatta | D21/676 |
| 7,166,790 | B2 | * | 1/2007 | May | 84/421 |
| 7,326,842 | B2 | * | 2/2008 | May | 84/421 |
| 2005/0183565 | A1 | * | 8/2005 | May | 84/421 |
| 2006/0186151 | A1 | | 8/2006 | May | 224/265 |
| 2008/0217368 | A1 | * | 9/2008 | Denton | 224/159 |
| 2008/0264236 | A1 | * | 10/2008 | Miyajima | 84/421 |

OTHER PUBLICATIONS

Ludwig Marching Drum Carrier, viewed Sep. 17, 2008 at http://www.bandshoppe.com/catalog/productDetail.do?p=Ludwig_Marching_Sextuplets_Drum_Carrier.*

DSI Drum Carriers and Accessories, viewed Sep. 17, 2008 at http://www.dshowcase.com/products/equipment-carriers/drum-carriers-and-accessories.html.*

* cited by examiner

*Primary Examiner*—Jeffrey Donels
*Assistant Examiner*—Robert W Horn
(74) *Attorney, Agent, or Firm*—Ostrolenk, Faber, Gerb & Soffen, LLP

(57) ABSTRACT

A marching carrier includes rods for supporting a musical instrument, a carrier main body to be in contact with a front face of a trunk of a player, a frame put on both shoulders of the player, a pair of shoulder cushions pivotably attached to the frame, and a back cushion pivotably attached to the frame. In the marching carrier, angles of the shoulder cushions and the back cushion to the frame can be adjusted separately.

12 Claims, 8 Drawing Sheets

MARCHING CARRIER

BACKGROUND OF THE INVENTION

The present invention relates to a marching carrier for supporting a musical instrument such as a marching drum on the front of a player.

A player plays the musical instrument such as the marching drum supported by a shoulder marching carrier in a parade or the like, for example. In this case, the player may play the musical instrument not only when he/she is standing still but also when he/she is moving. Therefore, the marching carrier needs to ensure that the musical instrument is supported on a body of the player. For this reason, a mainstream type of marching carriers is not a belt type for hanging and supporting the musical instrument but a type in which a hook-shaped shoulder portion placed over both shoulders of the player and a plate portion for supporting the musical instrument are integrated with each other.

However, though such an integrated marching carrier can reliably support the musical instrument, its shoulder portion is not deformed along the body of the player unlike the belt-type marching carrier. As a result, no sufficient contact areas between the marching carrier and the player can be obtained and a load of the musical instrument concentrates on specific positions such as shoulders and a back of the player to thereby increase the load on the player. Therefore, in order to lighten the load on the player, there is proposed a carrier in which a shape, a position, and the like of a shoulder portion are adjustable according to the body of the player. For example, the U.S. Pat. No. 1,191,425 discloses a carrier including an upper plate, arms pivotably coupled to an upper end of the upper plate, and a lower plate pivotably coupled to a lower end of the upper plate. The U.S. Pat. No. 4,799,610 discloses a marching carrier including a pair of shoulder bars, in which a distance between both shoulder bars can be changed. The U.S. Pat. No. 6,323,407 discloses a marching carrier including a pair of straps pivotably coupled to upper ends of frames. The U.S. Pat. No. 6,881,886 discloses a marching carrier in which lengths of shoulder straps can be changed. The U.S. Patent Application Publication No. 2006/0186151 discloses a marching carrier in which thicknesses of back cushions can be changed by blowing air into the back cushions.

When the player supports the musical instrument on his/her front by using any of the above carriers, the player mainly receives the load of the musical instrument on his/her respective parts, e.g., an abdomen, a back, and shoulders, which are in contact with the carrier. However, according to the carrier disclosed in each of the above documents, the carrier cannot be adjusted separately for the respective parts such as the back and shoulders of the player, though angles and positions of the shoulder portions are adjustable. As a result, no sufficient contact areas between the parts and the carrier can be obtained depending on shapes of the back and shoulders of the player. Especially when the musical instrument supported on the marching carrier is heavy in weight, the load of the musical instrument concentrates on specific parts such as the back and shoulders of the player and the load on the player is not lightened.

SUMMARY OF THE INVENTION

It is an objective of the present invention to provide a marching carrier for suppressing concentration of a load of a musical instrument on specific parts of a back and shoulders of a player so that a load on the player is lightened.

To achieve the foregoing objective and in accordance with one aspect of the present invention, a marching carrier for supporting a musical instrument on the front of a player is provided. The marching carrier includes a carrier main body to be in contact with a front face of a trunk of the player, a support member mounted to a lower portion of the carrier main body to support the musical instrument, a frame provided to an upper portion of the carrier main body and disposed on the front and back of both shoulders of the player along the shoulders, a pair of shoulder cushions pivotably attached to the frame to be in contact with both shoulders of the player, and a back cushion pivotably attached to the frame to be in contact with a back of the player. Angles of the shoulder cushions and the back cushion to the frame can be adjusted separately.

DETAILED DESCRIPTION OF THE PREFERRED EMBODIMENTS

One embodiment of the present invention will be described below with reference to FIGS. 1 to 9.

Figure 1:
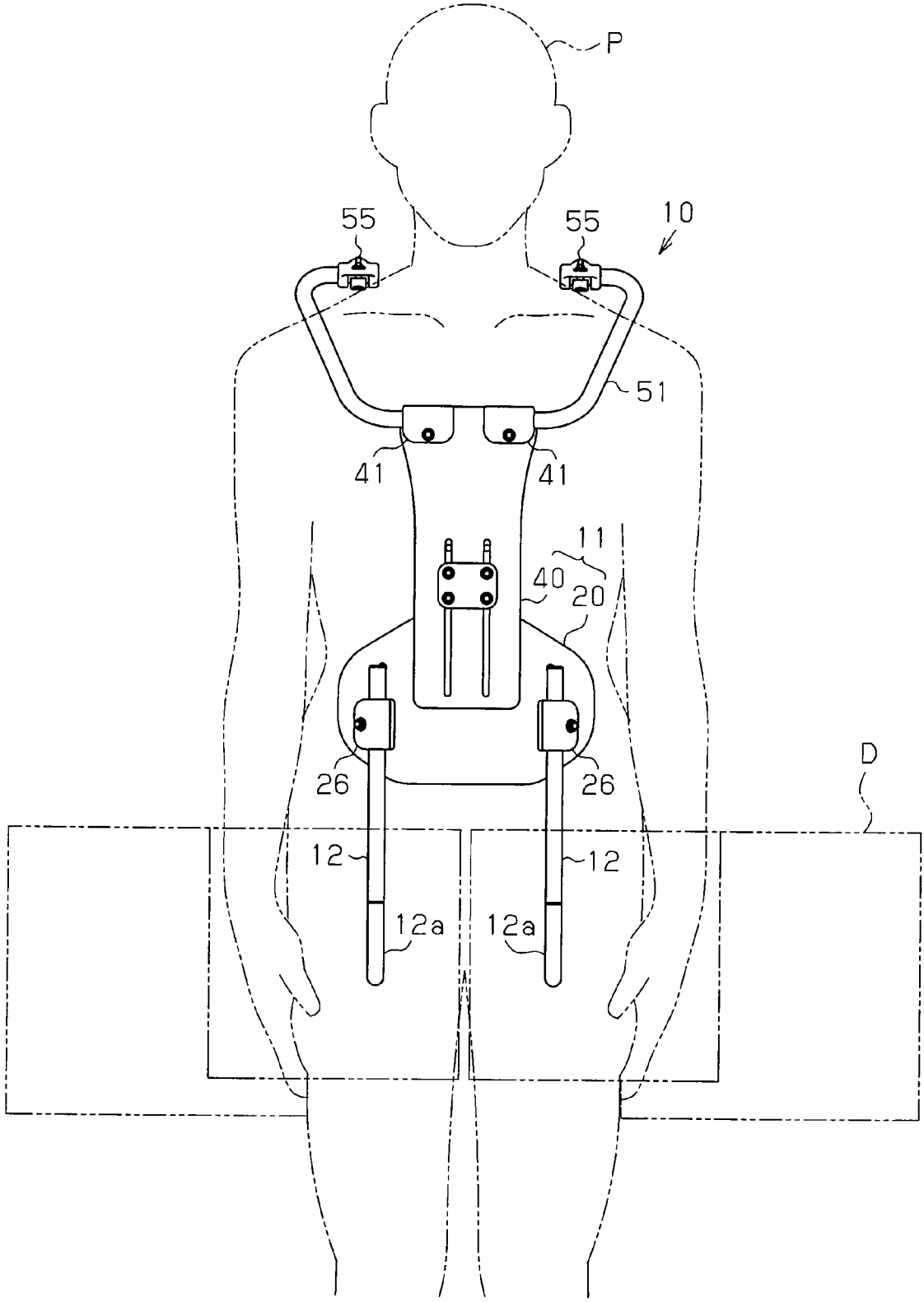
FIG. 1 is a plan view of a marching carrier according to one embodiment, showing a state in which a player is wearing the marching carrier.
Figure 2:
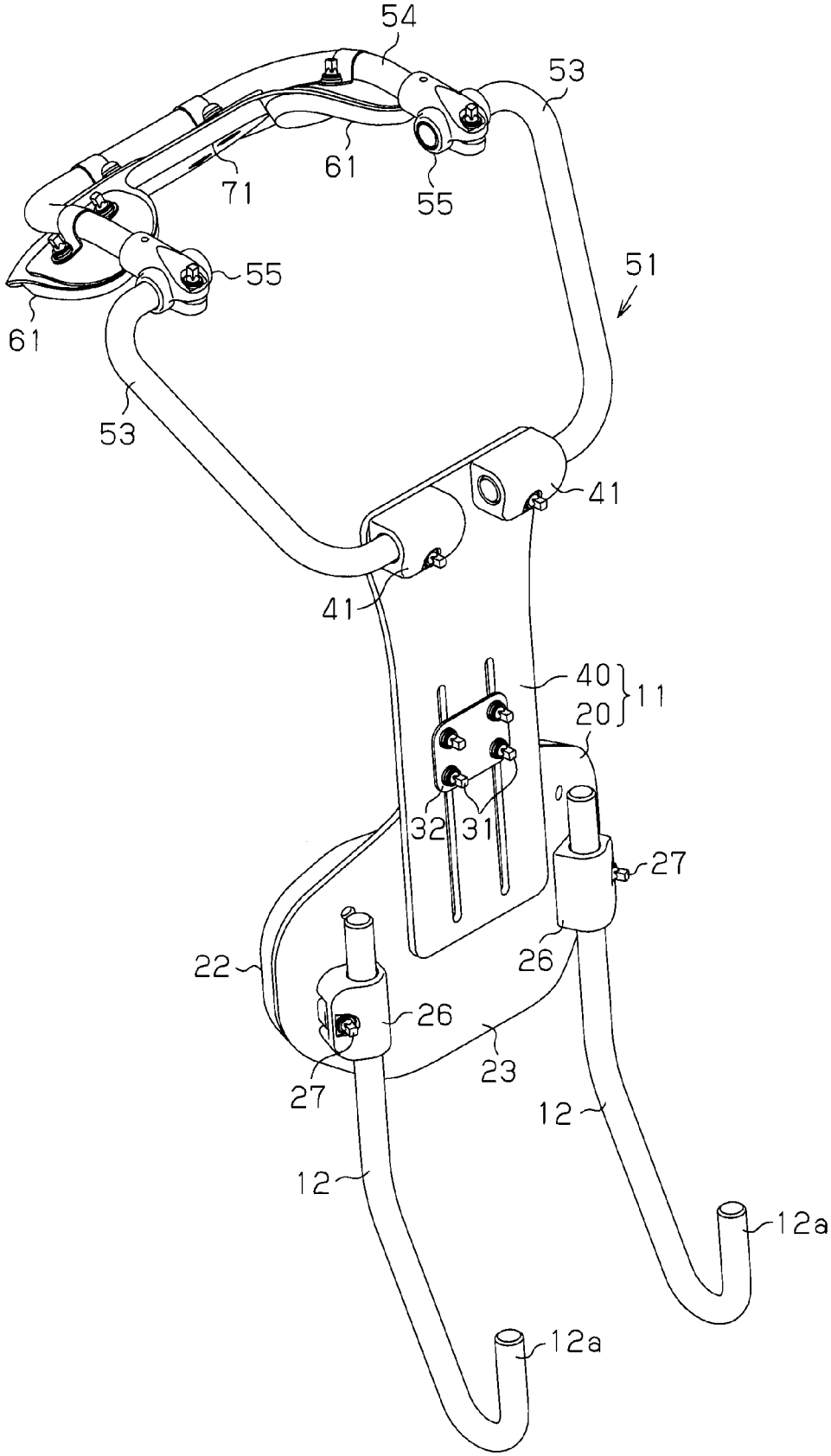
FIG. 2 is a perspective view illustrating the entirety of the marching carrier.

As shown in FIGS. 1 and 2, a marching carrier 10 includes a carrier main body 11 covering a front face of a trunk of a player P and a frame 51 placed along both shoulders of the player P in a front-back direction. A pair of rods 12 as support members for supporting a percussion instrument D such as a marching drum is attached to a lower portion of the carrier main body 11. A hook 12*a* for mounting the percussion instrument D is provided at a lower end portion of each of the rods 12. A side face of the percussion instrument D has a fixing portion (not shown) to which the hook 12*a* of each rod 12 is fixed.

Figure 3:
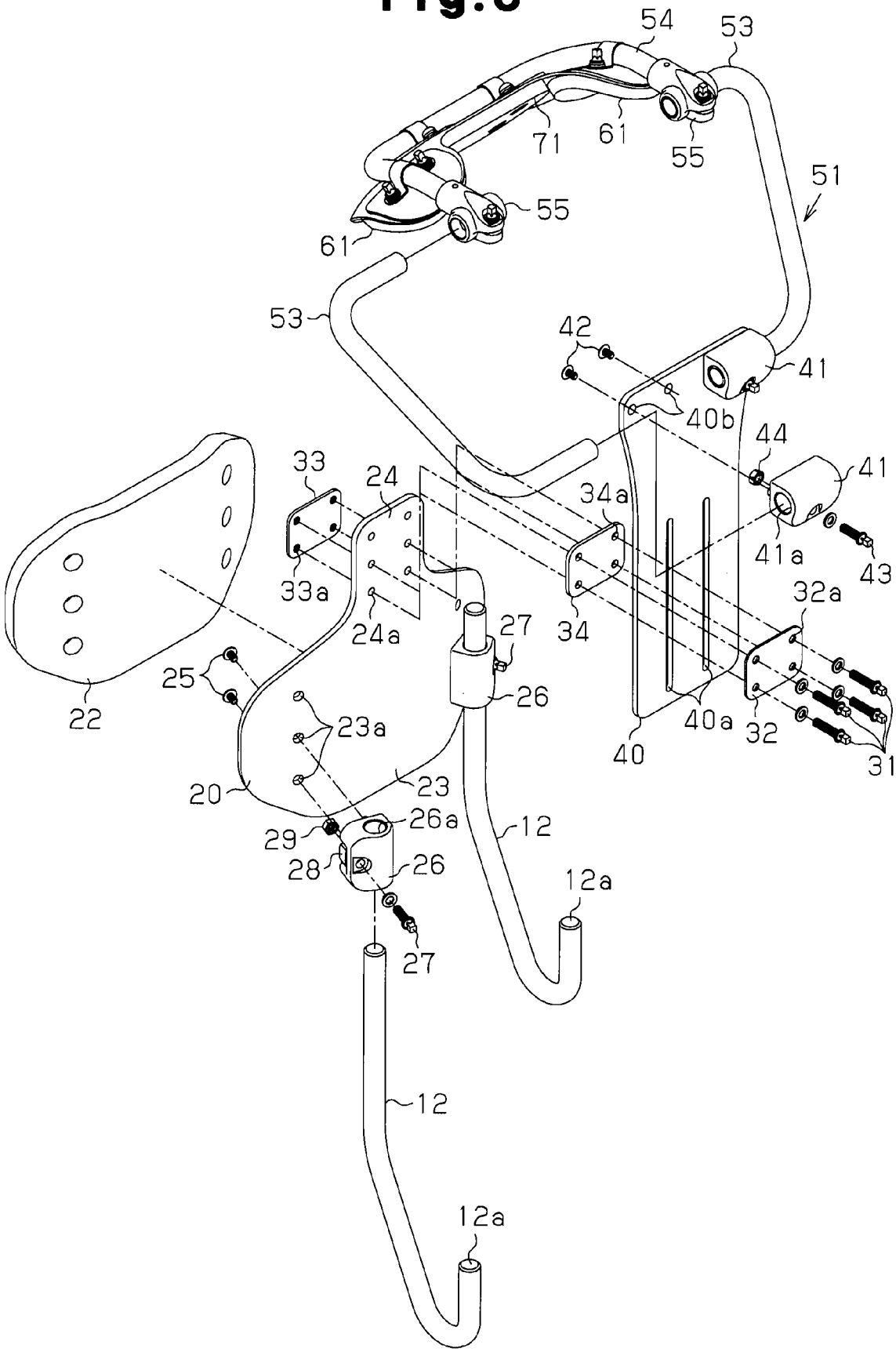
FIG. 3 is an exploded perspective view showing a carrier main body of the marching carrier.

As shown in FIGS. 2 and 3, the carrier main body 11 includes an upper plate 40, a lower plate 20, and a cushion member 22 attached to a back face of the lower plate 20. The lower plate 20 is formed of a plate member made of metal, resin, or the like having rigidity. The lower plate 20 has a substantially elliptic abdomen portion 23 facing the abdomen of the player P and a coupling portion 24 protruding upward from the abdomen portion 23. The abdomen portion 23 is so formed as to be curved along a shape of the abdomen of the player P.

To a front face of the abdomen portion 23, a pair of rod holders 26 for retaining the pair of rods 12 are attached. Each of the rod holders 26 is fixed by a plurality of screws 25 respectively inserted into a plurality of fixing holes 23*a* from a back face of the lower plate 20. At a center of each rod holder 26, a vertical hole 26*a* through which an upper end portion of the rod 12 is inserted is formed. Each rod 12 is retained in the rod holder 26 through a retaining member 28 by fastening a bolt 27 inserted from the front of the rod holder 26 into a nut 29. The rods 12 of the pair are fixed to opposite portions of the abdomen portion 23 of the lower plate 20 while retained by the rod holders 26. The cushion member 22 is a portion to be in contact with the abdomen of the player P. The cushion member 22 is made of material such as sponge and polyurethane and is in a substantially elliptic shape.

The lower plate 20 is coupled at its coupling portion 24 to a lower portion of the upper plate 40 by four bolts 31, a washer plate 32, and a nut plate 33. Between the coupling portion 24 of the lower plate 20 and the upper plate 40, a spacer 34 in a shape of a rectangular plate is interposed. The washer plate 32 and the spacer 34 are respectively formed with insertion holes 32*a*, 34*a* through which the respective bolts 31 are inserted. The nut plate 33 is formed with threaded holes 33*a* into which tip ends of the respective bolts 31 are screwed.

The upper plate 40 is formed of a plate made of metal, resin, or the like having rigidly, like the lower plate 20. The upper plate 40 is formed with a pair of grooves 40*a* extending from a lower end to a center. The four bolts 31 are inserted from the front of the upper plate 40 into the insertion holes 32*a* of the washer plate 32, the grooves 40*a* of the upper plate 40, and the respective insertion holes 34*a*, 24*a* of the spacer 34 and the coupling portion 24 in this order and fastened to the threaded holes 33*a* of the nut plate 33. Thus, the lower plate 20 is immovably coupled to the upper plate 40. On the other hand, by loosening the respective bolts 31, the bolts 31 become movable in both the grooves 40*a* of the upper plate 40. As a result, the lower plate 20 becomes movable along a height direction with respect to the upper plate 40 and it is possible to adjust height of the lower plate 20 with respect to the upper plate 40.

The frame 51 is formed of a pair of front frames 53 coupled to the upper plate 40 and a back frame 54 connecting back ends of both front frames 53. Each of the front frames 53 is formed of a metal rod into a U shape and is bent inward at its front end and back end, respectively. The back frame 54 is also formed of a metal rod into a U shape and is bent forward at its opposite end portions, respectively. Each front frame 53 is pivotably coupled at its front end portion to the upper plate 40 through a frame holder 41. Moreover, each front frame 53 is pivotably coupled at its back end portion to the back frame 54 through a hinge 55. In other words, the back frame 54 is pivotably coupled at its opposite end portions to both front frames 53 through the pair of hinges 55. In the embodiment, the frame 51 is formed as a substantially annular shoulder portion to be put on both shoulders of the player P.

Figure 6:
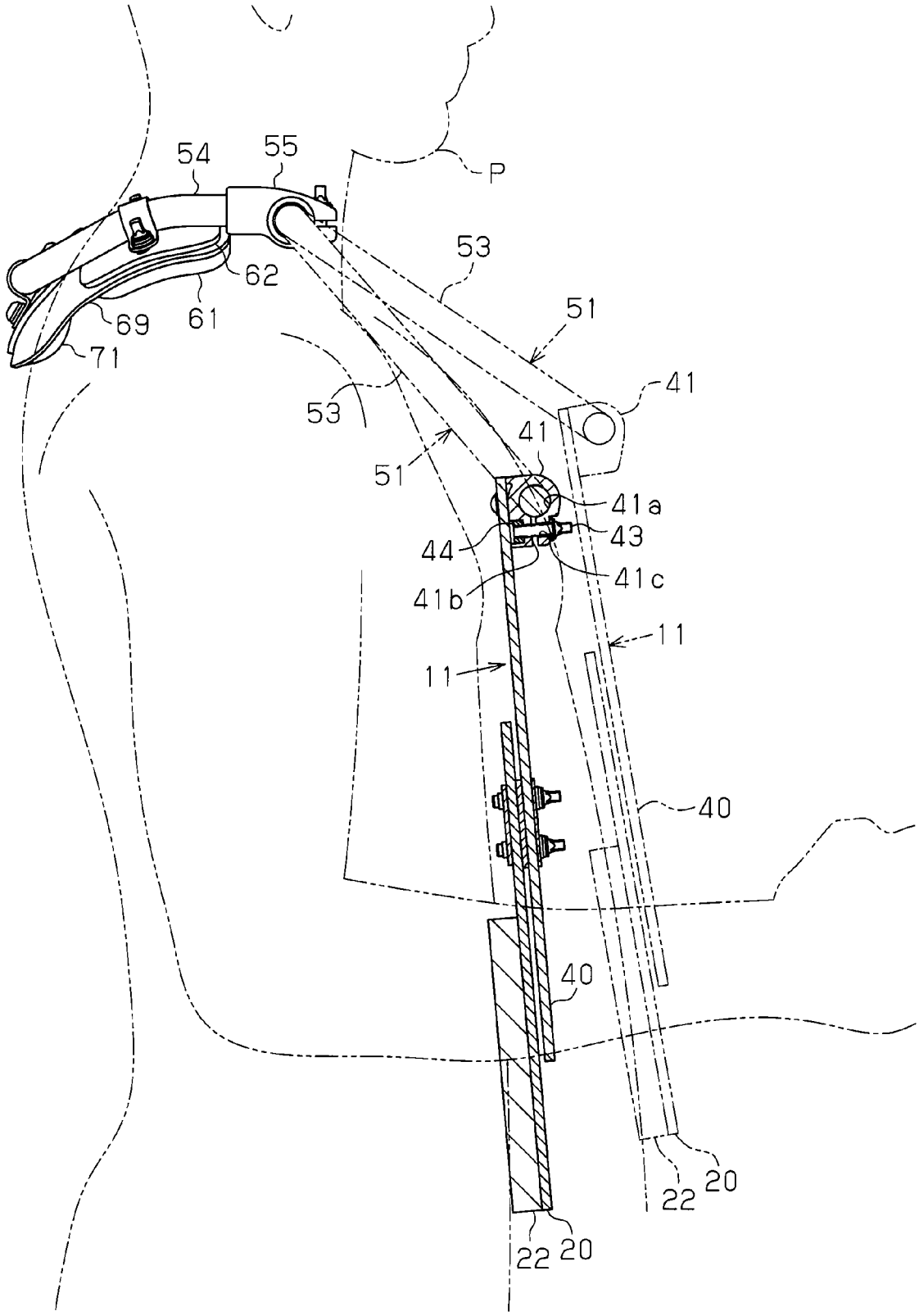
FIG. 6 is an explanatory drawing showing an operation of the carrier main body of the marching carrier.

A pair of frame holders 41 for retaining the frame 51 are respectively fixed to the upper plate 40 by a plurality of screws 42 inserted from the back of the upper plate 40. As shown in FIG. 6, each frame holder 41 has a first lateral hole 41*a* into which a front end of the frame 51 is inserted, a slit 41*b* open downward from the first lateral hole 41*a*, and a second lateral hole 41*c* into which a bolt 43 is inserted. Furthermore, a recess is formed on a back side of the frame holder 41 and a nut 44 in which the bolt 43 is to be screwed is housed in the recess. By fastening the bolt 43 inserted from the front of the frame holder 41 into the nut 44, a diameter of the first lateral hole 41*a* of the frame holder 41 is reduced. Thus, the front end of the frame 51 is fastened to the frame holder 41. As a result, the frame 51 is coupled to the upper plate 40 so as not to be pivotable, such that an angle of the frame 51 to the carrier main body 11 is fixed. On the other hand, by loosening each bolt 43, fastening by the frame holder 41 is cancelled, the frame 51 can pivot with respect to the upper plate 40, and the angle of the frame 51 to the carrier main body 11 can be adjusted. In the embodiment, the frame 51 is formed as the substantially annular shoulder portion to be put on both shoulders of the player P.

Figure 7:
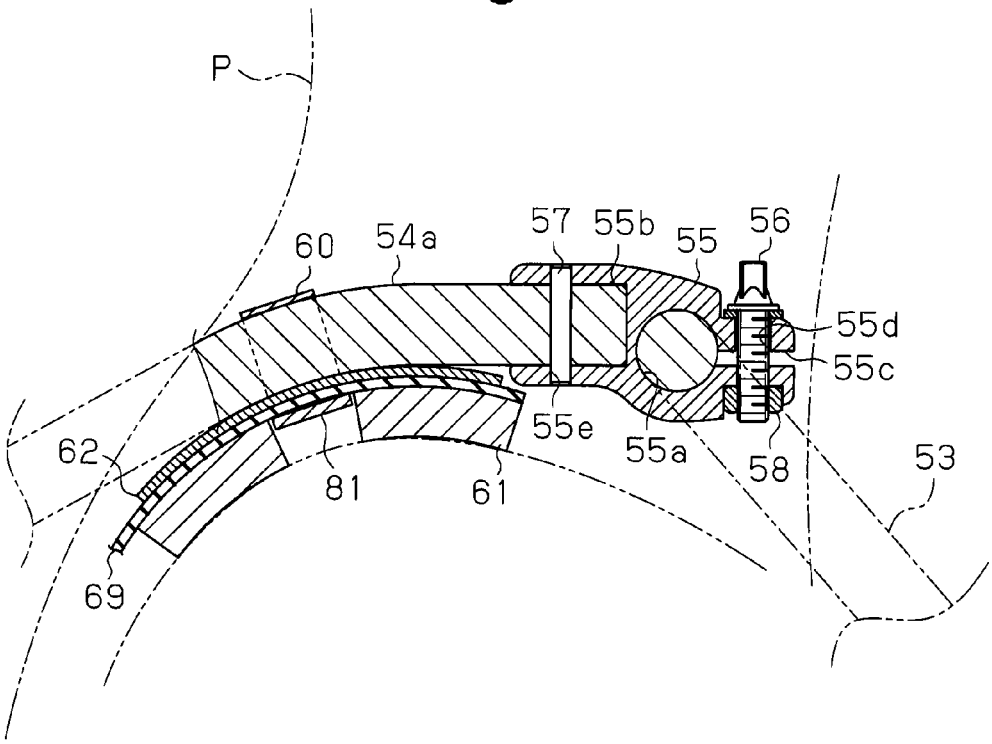
FIG. 7 is a cross-sectional view taken along line 7-7 in FIG. 5.

As shown in FIG. 7, each hinge 55 has a first lateral hole 55*a* into which the back end of the front frame 53 is inserted, a second lateral hole 55*b* into which the front end of the back frame 54 is inserted, a slit 55*c* open forward from the first lateral hole 55*a*, a first vertical hole 55*d* into which a bolt 56 is inserted, and a second vertical hole 55*e* into which a spring pin 57 is inserted. The back frame 54 is fixed in the second lateral hole 55*b* by the spring pin 57 inserted from above the hinge 55. A recess is formed on a back side of the hinge 55 and a nut 58 into which the bolt 56 is screwed is housed in the recess. By fastening the bolt 56 inserted from above the hinge 55 into the nut 58, a diameter of the lateral hole 55*a* of the hinge 55 is reduced and each front frame 53 is fastened to the corresponding hinge 55. Thus, the back frame 54 is coupled to the front frames 53 so as not to be pivotable and angles of the back frame 54 to the front frames 53 are fixed. On the other hand, by loosening each bolt 56, fastening by each hinge 55 is cancelled, the back frame 54 can pivot with respect to the front frame 53, and the angle of the back frame 54 to the front frame 53 can be adjusted.

Figure 4:
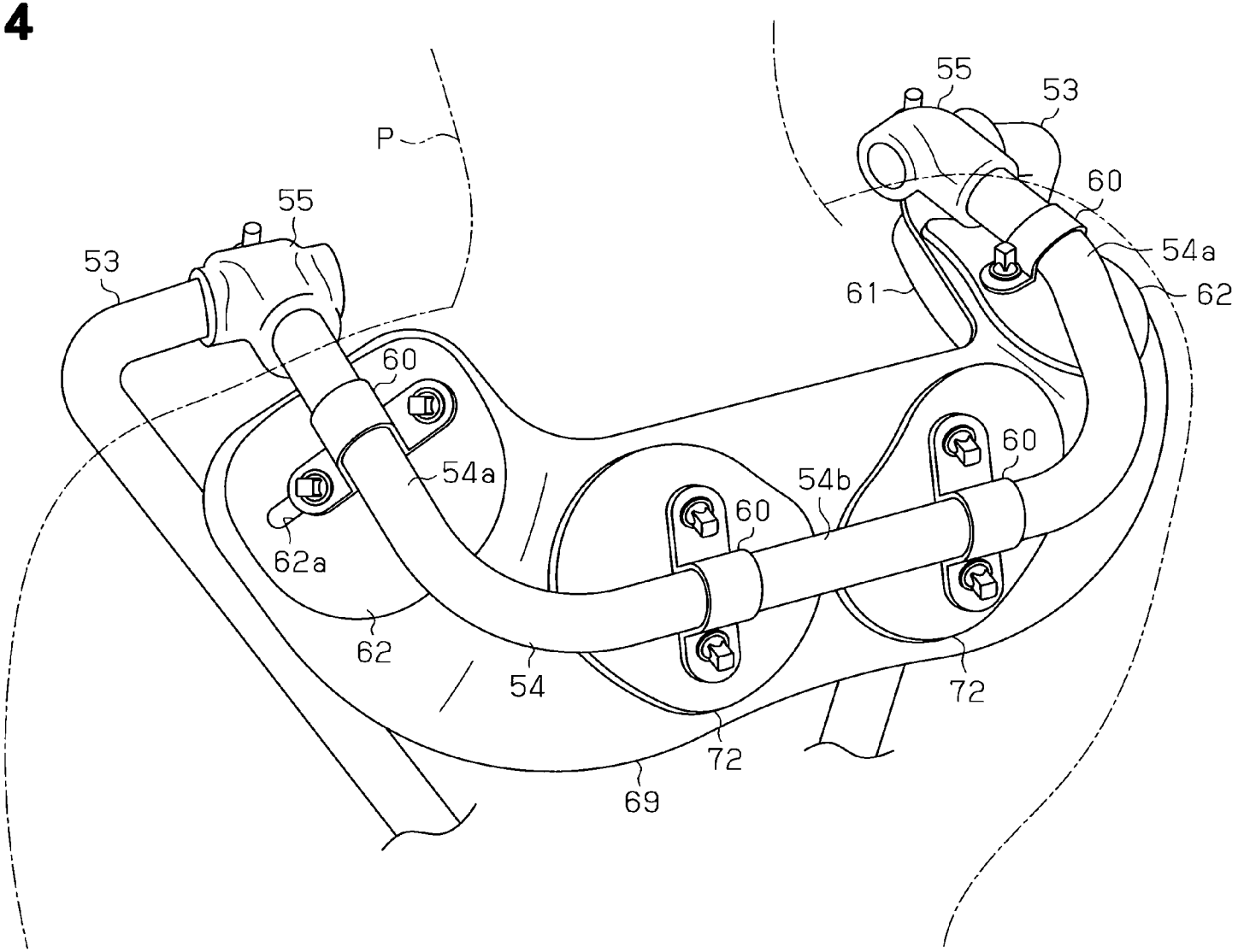
FIG. 4 is an enlarged partial perspective view showing a back frame of the marching carrier.
Figure 5:
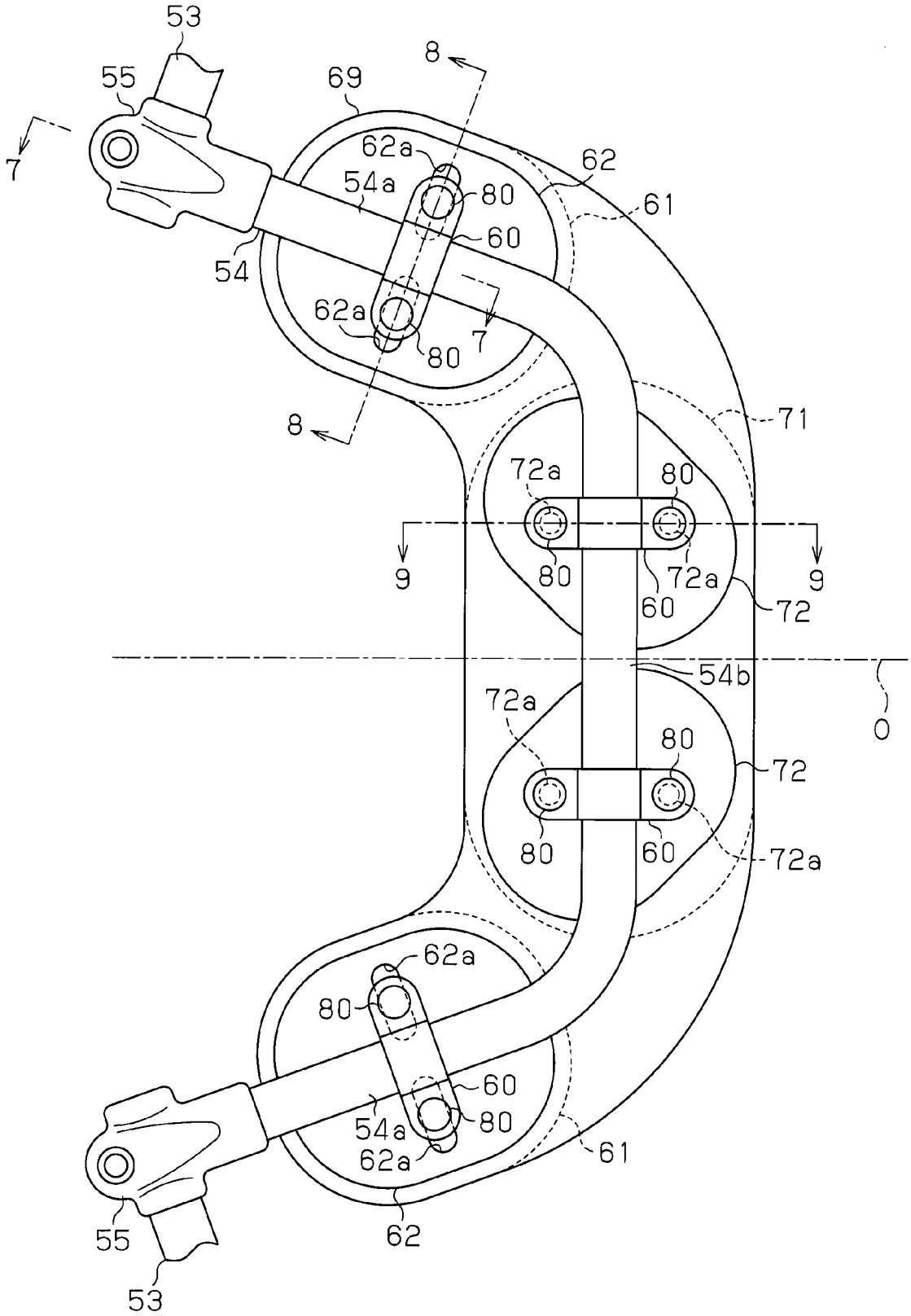
FIG. 5 is an enlarged partial plan view showing the back frame of a marching carrier.

As shown in FIGS. 4 and 5, the back frame 54 includes a pair of first frame portions 54*a* and extending diagonally backward from the respective hinges 55 and a second frame portion 54*b* connecting both first frame portions 54*a*. To each first frame portion 54*a* of the back frame 54, a substantially elliptic shoulder plate 62 is attached by a clamp 60. The shoulder plate 62 is formed of a plate member made of metal, resin, or the like having rigidity and curved along a shape of the shoulder of the player P. The shoulder plate 62 has a pair of elongated holes 62*a* of on opposite sides of the first frame portion 54*a*. Both elongated holes 62*a* extend in a direction orthogonal to a center of the first frame portion 54*a*.

Figure 8:
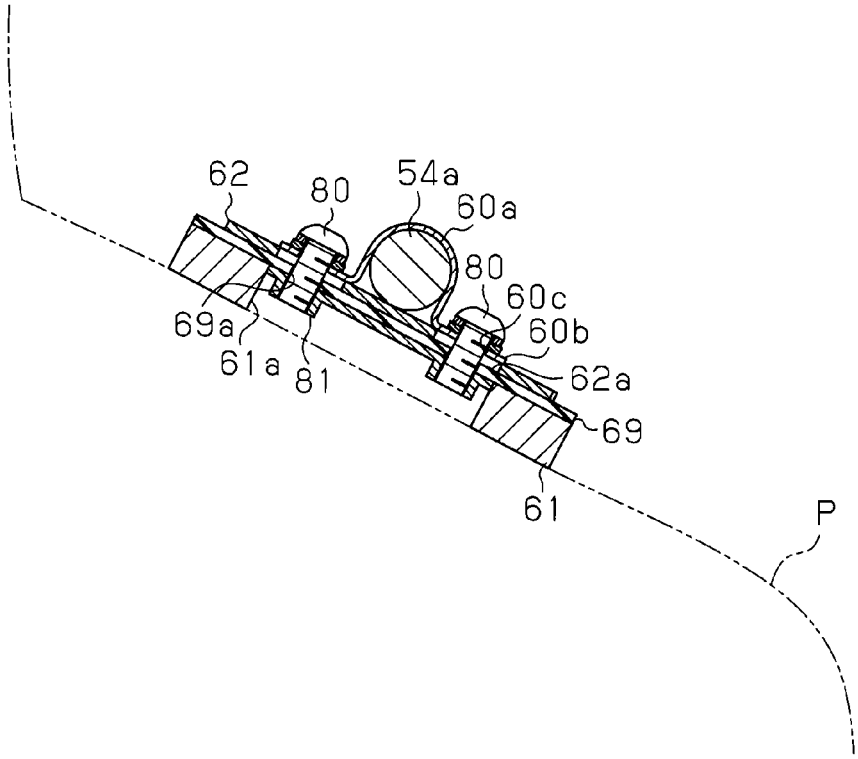
FIG. 8 is a cross-sectional view taken along line 8-8 in FIG. 5.

As shown in FIGS. 7 and 8, each clamp 60 includes a retaining portion 60*a* having a U-shaped cross-section and retaining the back frame 54, and a pair of fixing pieces 60*b* respectively extending outward from the retaining portion 60*a*. At a center of each fixing piece 60*b*, an insertion hole 60*c* into which a bolt 80 is to be inserted is formed. On a back side of each shoulder plate 62, a shoulder cushion 61 is disposed through a cushion base 69. Each shoulder cushion 61 is made of elastic material such as polyurethane and sponge. The cushion base 69 is made of material such as rubber having flexibility and extends in a substantially U shape along an axis of the back frame 54. The cushion base 69 positions both of the shoulder plates 62 and back plates 72 while providing freedom in positions of both plates 62, 72. The respective shoulder cushions 61 are bonded to back faces of opposite end portions of the cushion base 69 and are put to the shoulders of the player P by the shoulder plates 62. Furthermore, the shoulder cushions 61 and the cushion base 69 are respectively formed with insertion holes 61*a*, 69*a* at positions corresponding to the respective elongated holes 62*a* of the respective shoulder plates 62.

By fastening bolts 80 inserted from above the shoulder plate 62 and through the fixing pieces 60*b* of the clamp 60 into nuts 81 in the insertion holes 61*a* in the shoulder cushion 61, the shoulder plate 62, the shoulder cushion 61, and the cushion base 69 are integrated with each other and an angle of the shoulder cushion 61 to the first frame portion 54*a* of the back frame 54 is fixed. On the other hand, by loosening the respective bolts 80, each shoulder plate 62 can pivot with respect to the first frame portion 54*a* of the back frame 54. In this case, since the shoulder cushion 61 can also pivot with respect to the first frame portion 54*a*, the angle of the shoulder cushion 61 to the first frame portion 54*a* is adjusted according to a slope of the shoulder of the player P. In other words, by changing the angle of the shoulder plate 62, the angle of the shoulder cushion 61 is also adjusted together with the shoulder plate 62.

In this state, the bolts 80 are movable in the elongated holes 62*a* of the shoulder plate 62 and the shoulder plate 62 is movable in a lateral direction with respect to the first frame portions 54*a*, i.e., along a direction of the slope of the shoulder from a neck to an arm of the player P shown in FIG. 8. In this case, since the shoulder cushion 61 also becomes movable together with the shoulder plate 62, a lateral attached position of the shoulder cushion 61 with respect to the first frame portion 54*a* is adjusted according to a shoulder width of the player P. Moreover, in this state, the shoulder plate 62 is movable along the first frame portion 54*a*. In this case, since the shoulder cushion 61 also becomes movable together with the shoulder plate 62, an attached position of the shoulder plate 62 with respect to the first frame portion 54*a* in a front-back direction is adjusted.

As shown in FIGS. 4 and 5, a pair of the back plates 72 are attached to the second frame portion 54*b* of the back frame 54 by clamps 60. Each of the back plates 72 is formed of a plate member made of metal, resin, or the like having rigidity like the shoulder plate 62 and curved along a shape of the back of the player P. The back plate 72 has a pair of insertion holes 72*a* on opposite sides of the second frame portion 54*b*. The respective adjacent back plates 72 are disposed symmetrically with respect to a center line 0 of a body of the player P and disposed at a predetermined distance from each other. On back sides of both back plates 72, back cushions 71 are disposed through the cushion base 69. The back cushions 71 are made of elastic material such as polyurethane and sponge similarly to the shoulder cushions 61 and have substantially elliptic shapes having greater lateral dimensions than the shoulder cushions 61. The back cushions 71 are bonded to a back face of a central portion of the cushion base 69 and put to the back of the player P by both back plates 72.

Figure 9:
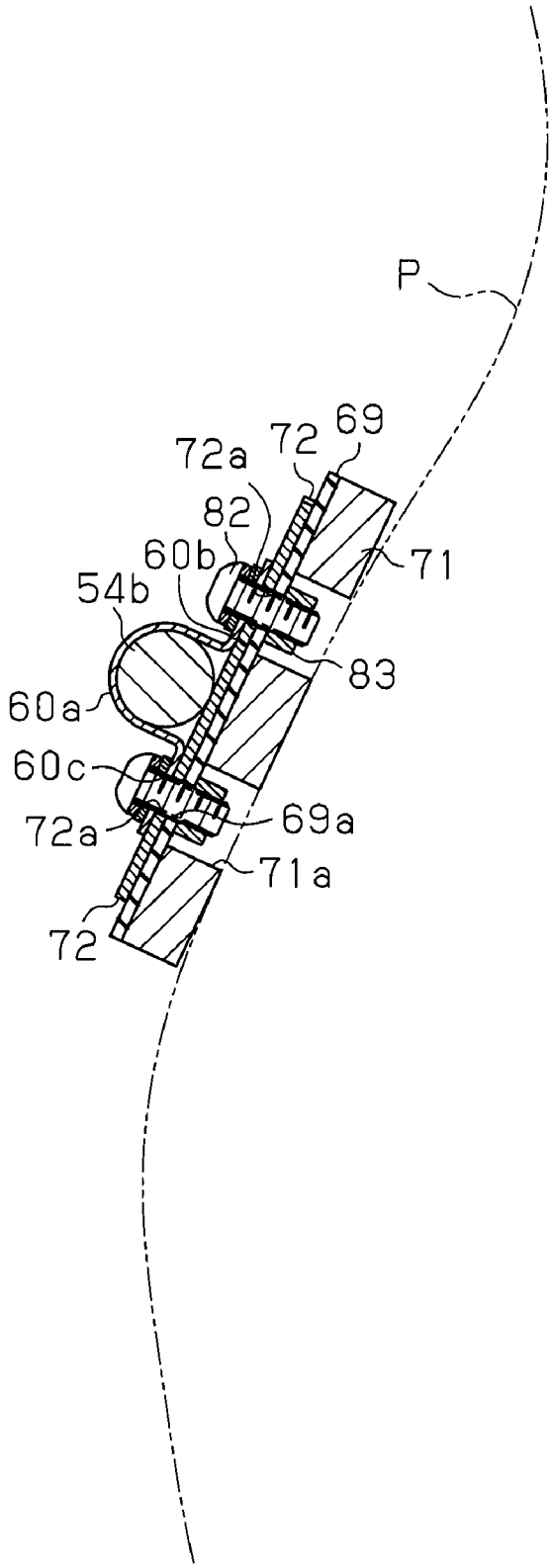
FIG. 9 is a cross-sectional view taken along line 9-9 in FIG. 5.

As shown in FIG. 9, the back cushion 71 and the cushion base 69 are also formed with insertion holes 71*a*, 69*a*, respectively, in positions corresponding to the insertion holes 72*a* of the back plate 72. By fastening bolts 82 inserted from the back of the back plate 72 through fixing pieces 60*b* of a clamp 60 to nuts 83 in the insertion holes 71*a* of the back cushion 71, the back plate 72, the back cushion 71, and the cushion base 69 are integrated with each other and an angle of the back cushion 71 to the second frame portion 54*b* of the back frame 54 is fixed. On the other hand, by loosening the respective bolts 82, each of the back plates 72 can be pivoted with respect to the second frame portion 54*b* of the back frame 54. In this case, since the back cushion 71 can be also pivoted with respect to the second frame portion 54*b*, an angle of the back cushion 71 to the second frame portion 54*b* is also adjusted according to a slope of the back from the neck to hips of the player P. In other words, by changing the angle of the back plate 72, the angle of the back cushion 71 is adjusted together with the back plate 72.

The present embodiment provides the following advantages.

(1) The respective shoulder cushions 61 are pivotably attached to the first frame portions 54*a* of the back frame 54 and the back cushions 71 are pivotably attached to the second frame portion 54*b* of the back frame 54. In this case, the angles of the shoulder cushions 61 and the angles of the back cushions 71 to the frame 51 can be adjusted separately according to the shapes of the shoulders and back of the player P. Thus, it is possible to obtain sufficient contact areas between the body of the player P and the shoulder cushions 61 and back cushions 71. As a result, when the player P supports the percussion instrument D on his/her front, it is possible to suppress concentration of the load of the percussion instrument D on specific parts of the shoulders and back of the player P to thereby lighten the load on the player P.

(2) The shoulder cushions 61 are movably attached to the first frame portions 54*a* of the back frame 54. In this case, the attached positions of the shoulder cushions 61 in the front-rear direction with respect to the frame 51 can be adjusted according to the positions of the shoulders of the player P. As a result, it is easy to obtain sufficient contact areas between the shoulders of the player P and the shoulder cushions 61.

(3) The frame 51 is formed of a pair of the front frames 53 and the back frame 54 and the back frame 54 is pivotably coupled to both front frames 53. In this case, by adjusting the angle of the back frame 54 to the front frames 53 according to the figure of the player P, it is possible to further reduce the degree to which the frame 51 projects forward. As a result, it is possible to further enhance the appearance when the player P wears the marching carrier 10 and further wears clothes on it.

(4) The shoulder plates 62 are movably attached along a lateral direction to the first frame portions 54*a* of the back frame 54. In this case, the lateral attached positions of the shoulder cushion 61 to the frame 51 can be adjusted according to the shoulder width of the player P. As a result, it is easier to obtain the contact areas between the shoulders of the player P and the shoulder cushions 61.

(5) The lower plate 20 is movably coupled along a height direction to the upper plate 40. In this case, the height of the lower plate 20 can be adjusted according to a position of the abdomen with respect to the shoulders of the player P. As a result, it is possible to suppress concentration of the load of the percussion instrument D on specific parts such as the abdomen, shoulders, and back of the player P to thereby further lighten the load on the player P.

(6) The frame 51 is pivotably coupled to the upper plate 40 of the carrier main body 11. In this case, by adjusting the angle of the frame 51 to the carrier main body 11 according to the figure of the player, the width of the marching carrier 10 in the front-rear direction can be adjusted. As a result, it is possible to minimize a clearance between the trunk of the player P and the marching carrier 10 to thereby improve a feeling of fit between the player P and the marching carrier 10.

(7) The shoulder cushions 61 are disposed on the back sides of the shoulder plates 62 pivotably attached to the frame 51. By changing the angles of the shoulder plates 62 to the frame 51, the angles of the shoulder cushions 61 are adjusted. In this case, the angles of the shoulder cushions 61 can be easily adjusted by the shoulder plates 62 and the angles of the shoulder cushions 61 can be maintained reliably.

(8) The back cushions 71 are disposed on the back sides of the back plates 72 pivotably attached to the frame 51. By changing the angles of the back plates 72 to the frame 51, the angles of the back cushions 71 can be adjusted. In this case, the angles of the back cushions 71 can be easily adjusted by the back plates 72 and the angles of the back cushions 71 can be maintained reliably.

(9) The respective back plates 72 are disposed symmetrically with respect to the center line O of the trunk of the player P. In this case, since the positions of the respective back plates 72 are set in parts other than a position of a backbone of the player P, it is possible to lighten the load on the player P and to reduce an uncomfortable feeling when the player P wears the marching carrier 10.

The above embodiment may be modified in the following manners.

In the embodiment, a coupling structure between the front frames 53 and the back frame 54 may be modified in the following way. For example, the back frame 54 may be movably attached to the front frames 53 so that coupled positions of the back frame 54 to the front frames 53 in the front-rear direction can be adjusted. In this case, by adjusting the coupled positions of the back frame 54 to the front frames 53 in the front-rear direction according to the figure of the player P, it is possible to reduce a degree to which the frame 51 projects forward. As a result, it is possible to further enhance an appearance when the player P wears the marching carrier 10 and further wears clothes on it. Moreover, it is possible to make a clearance between the trunk of the player P and the marching carrier 10 as small as possible to thereby further improve a feeling of fit between the player P and the marching carrier 10.

Although the shoulder cushions 61 and the shoulder plates 62 are fixed to the first frame portions 54*a* of the back frame 54 by fastening the respective bolts 80 in the illustrated embodiment, they may be attached to the first frame portions 54*a* of the back frame 54 such that they can always pivot. Similarly, although the back cushions 71 and the back plates 72 are fixed to the second frame portion 54*b* of the back frame 54 by fastening the respective bolts 82, they may be attached to the second frame portion 54*b* of the back frame 54 such that they can always pivot. In this case, the back plates 72 are supported by the cushion base 69 so as not to turn over when the player P puts on and takes off the marching carrier 10.

In the embodiment, the number of back cushions 71 may be two or more. Moreover, the number of back plates 72 may be changed according to the number of back cushions 71 or irrespective of the number of back cushions 71.

In the illustrated embodiment, the back frame 54 may be integrated with the front frames 53.

In the illustrated embodiment, the lower plate 20 may be integrated with the upper plate 40.

In the embodiment, the frame 51 may be integrated with the carrier main body 11.

In the illustrated embodiment, the marching carrier 10 may be applied to a carrier for supporting musical instruments other than the percussion instrument. Moreover, the shapes, the number, and the like of the rods 12 as the support members may be modified according to a kind and the number of instruments to be mounted to the marching carrier 10.

The invention claimed is:

1. A marching carrier for supporting a musical instrument on the front of a player, comprising:

a carrier main body to be in contact with a front face of a trunk of the player, the carrier main body having a lower portion and an upper portion;

a support member mounted to the lower portion of the carrier main body to support the musical instrument;

a frame secured to the upper portion of the carrier main body, the frame having a rod-shape and the frame being disposed at a front and a back of each shoulder of the player and extending along both shoulders;

a pair of shoulder cushions pivotably attached to the frame to be in contact with both shoulders of the player, the shoulder cushions being pivotable around a first axis of the frame; and a back cushion pivotably attached to the frame to be in contact with a back of the player, the back cushion being pivotable around a second axis of the frame, wherein angles of the shoulder cushions and the back cushion to the frame is separately adjustable.

2. The marching carrier according to claim 1, wherein the shoulder cushions are movably attached to the frame, and wherein positions of the shoulder cushions in a front-rear direction to the frame are adjustable.

3. The marching carrier according to claim 1, wherein the frame comprises a pair of front frames coupled to the carrier main body and one back frame coupled to back ends of both front frames, and wherein the back frame is attached to the front frames such that a position of the back frame is adjustable.

4. The marching carrier according to claim 3, wherein the back frame is pivotably coupled to the front frames, and wherein an angle of the back frame to the front frames is adjustable.

5. The marching carrier according to claim 1, wherein the shoulder cushions are attached to the frame to be movable along a lateral direction, and wherein positions of the shoulder cushions in the lateral direction to the frame are adjustable.

6. The marching carrier according to claim 1, wherein the carrier main body comprises an upper plate facing a chest of the player and comprises a lower plate facing an abdomen of the player, the lower plate being coupled to the upper plate to be movable along a height direction of the carrier, a height of the lower plate with respect to the upper plate being adjustable.

7. The marching carrier according to claim 1, wherein the frame is pivotably coupled to the carrier main body, and wherein an angle of the frame to the carrier main body is adjustable.

8. The marching carrier according to claim 1, further comprising shoulder plates pivotably attached to the frame, each shoulder plate having a back face and the shoulder cushions being disposed on the back faces of the shoulder plates, the angles of the shoulder cushions being adjustable by changing angles of the shoulder plates to the frame.

9. The marching carrier according to claim 1, further comprising a pair of back plates pivotably attached to the frame, each back plate having a back face and the back cushion being disposed on the back faces of the pair of back plates, the angle of the back cushion being adjustable by changing angles of the back plates to the frame.

10. The marching carrier according to claim 9, wherein a pair of the back plates is disposed symmetrically with respect to a center line of the trunk of the player.

11. The marching carrier according to claim 1, further comprising a cushion base operable to attach the shoulder cushions and the back cushion to the frame.

12. The marching carrier according to claim 1, further comprising a cushion base having the shoulder cushions and the back cushion secured thereon;

shoulder plates pivotally attached to the frame, each shoulder plate having a back face mounted on the cushion base such that each shoulder cushion is connected to the back face of one of the shoulder plate, the angles of the shoulder cushions being adjustable by changing angles of the shoulder plates to the frame; and a pair of back plates pivotally attached to the frame, each back plate having a back face mounted on the cushion base such that the back cushion is connected to the back faces of the black plates, the angle of the back cushion being adjustable by changing angles of the back plates to the frame.

* * * * *